United States Patent [19]

Goldenberg

[11] Patent Number: 4,824,105

[45] Date of Patent: Apr. 25, 1989

[54] ABDOMINAL EXERCISE DEVICE

[76] Inventor: Zinovy Goldenberg, 2074 20th La., Apt. 3E, Brooklyn, N.Y. 11214

[21] Appl. No.: 151,019

[22] Filed: Feb. 1, 1988

[51] Int. Cl.[4] ..... A63B 21/00

[52] U.S. Cl. ..... 272/130; 272/99; 128/30.2

[58] Field of Search ..... 272/99, 130, 143, 93, 272/135; 128/28, 30, 30.2

[56] References Cited

U.S. PATENT DOCUMENTS

| | | | |
|---|---|---|---|
| 2,762,366 | 9/1956 | Hoxley et al. | 128/30.2 |
| 2,869,537 | 1/1959 | Jen-Chu Chu | 272/99 |
| 3,042,024 | 7/1962 | Mendelson | 128/30.2 |
| 3,043,292 | 7/1962 | Mendelson | 128/30.2 |
| 3,401,686 | 9/1968 | Edwards | 272/99 X |
| 4,596,240 | 6/1986 | Takahashi et al. | 272/130 X |
| 4,666,148 | 5/1987 | Crawford | 272/130 X |
| 4,688,793 | 8/1987 | Syrek, III | 272/93 |
| 4,759,543 | 7/1988 | Feldman | 272/93 |
| 4,775,148 | 10/1988 | McLaughlin | 272/135 X |

FOREIGN PATENT DOCUMENTS

| | | | |
|---|---|---|---|
| 2043125 | 3/1972 | Fed. Rep. of Germany | 272/130 |
| 853465 | 3/1940 | France | 272/99 |

*Primary Examiner*—Richard J. Apley
*Assistant Examiner*—Robert W. Bahr
*Attorney, Agent, or Firm*—Nathaniel Altman

[57] ABSTRACT

A device for exercising abdominal muscles by intermittent stretching and relaxing, and for massaging internal organs in the abdominal and thoracic cavities functions by applying adjustable intermittent pressure inwardly and upwardly to the surface of an exerciser's abdomen. The exercise device comprises a body belt fastened around a user's waist and having an opening covered with an expandable inwardly-facing pocket positioned over the user's abdomen. An inflatable air-tight bag located within and attached to the pocket is connected to a hand-operated bellows-air pump, the pump being suspended from the body belt and resting on the user's thighs when in use. At rest, the air-tight bag is collapsed and lies flat within the pocket; hand pressure against the bellows-air pump forces air up into and inflates the bag so that it protrudes through the pocket opening and exerts pressure inwardly and upwardly against the abdomen and forces the abdominal muscles to be stretched into the abdominal cavity. As the bellows pump is released, air is withdrawn from the collapsing air-tight bag and the abdominal muscles are relaxed until the exercise cycle is repeated. Adjustably overlapping flaps are provided on the belt to be closed over the pocket, thus limiting the outward thrust of the inflatable bag and selectively controlling the force exerted against the user's abdomen.

2 Claims, 1 Drawing Sheet

ABDOMINAL EXERCISE DEVICE

BACKGROUND OF THE INVENTION

1. Field of the Invention

This invention relates to an exercise device generally, and particularly to a device for use in exercising a user's abdominal muscles. More specifically, this invention is concerned with an exercise device for assisting and improving the performance of abdominal lift exercises such as those associated with the wellknown Yoga physical fitness system. The device operates by applying an external force to the surface of the abdomen, stretching the abdominal muscles and thus enhancing the effectiveness of a general exercise program.

2. Description of the Prior Art

Although therapeutic medicine has clearly established the fact that muscles can retain their strength and elasticity only if they are forced to perform the equally important evenly balanced movements of both contracting and stretching, known exercise devices of the prior art are devoted to and limited to contraction of abdominal muscles only. The known exercisers are designed either for the development of mighty abdominal muscles or for superficially toning them by periodic contraction of these muscles against the resistance or impact produced by these devices.

The following are typical examples of the known prior art: (a) U.S. Pat. No. 4,257,589, issued on Mar. 24, 1981 to Homer G. Outlaw; and (b) Nautilus Abdominal Exercise Machine, manufactured by Nautilus Sport-/Medical Industries, Inc. Outlaw uses a bowling ball suspended in pendulum fashion to bounce repeatedly off the exerciser's stomach; the Nautilus Machine emphasizes muscle contraction. Neither these or any other device of the prior art provide the uniquely beneficial abdominal muscle stretching produced by the exercise device of the present invention.

SUMMARY OF THE INVENTION

The essence of abdominal lift exercise in general is to raise the body's diaphragm, in turn drawing the viscera into the thoracic cage and the abdomen into the abdominal cavity, by expanding the thorax in a mock inhalation of breath at a time when the lungs are completely empty and kept empty throughout each cycle of these exercises. While there may be variations of forces and timing involved in each phase of the exercise cycle, the fundamental principle remains unchanged: deep upward stretching of relaxed abdominal muscles followed by their contraction on return without the breath being drawn in. These movements cause the internal organs without the abdominal and thoracic cavities to be massaged, speed up the digestive process, promote elimination of waste, reduce excess abdominal fat, improve blood circulation and decongestion, and restore strength and elasticity to the muscles within these regions.

Effective abdominal lift exercises are among the most difficult to perform unaided, especially for people with excess abdominal fat, rigid abdominal muscles or poor coordination of the muscles and movements involved in these exercises. It is accordingly a principal object of the present invention to overcome these difficulties in accomplishing beneficial abdominal lift exercises by providing an easily usable exercise device capable of applying regulated external forces to the surface of the abdomen for enhancing the effectiveness of the forces produced by the accompanying general exercises. Another object of this invention is to provide individual adjustability of the magnitude and direction of the pressure being exerted on the user's abdomen by the device. A further object of the invention is to provide continous control of the forces applied during a full cycle of the exercises.

These and other objectives of the present invention will be disclosed in full detail in connection with the accompanying illustrative drawings, wherein:

DESCRIPTION OF THE PREFERRED EMBODIMENT

Figure 1:
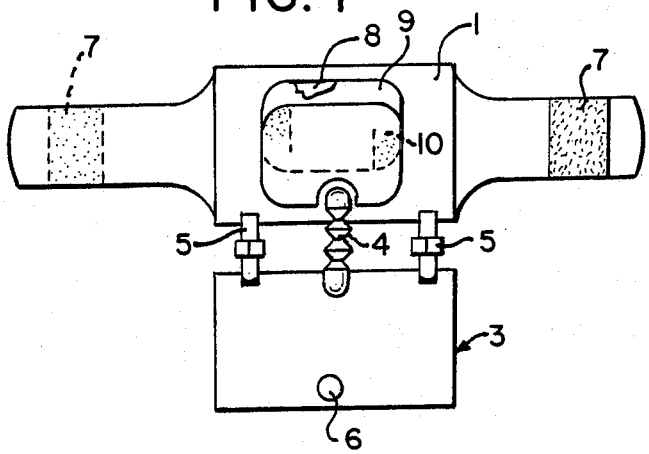
FIG. 1 is a front elevational view of a preferred embodiment of the abdominal exercise device of this invention.

The best mode now contemplated for practicing this invention is shown in the drawings and includes flexible body belt 1 shaped and dimensioned to fit adjustably around a user's waist covering the abdomen, and to be held firmly in place when fastening elements 7 are connected at the user's back. Elements 7 are shown as the convenient hook-and-loop type fastener strips marketed under the trade name "Velcro", but obviously other conventional fastening means may be used in their place.

Figure 3:
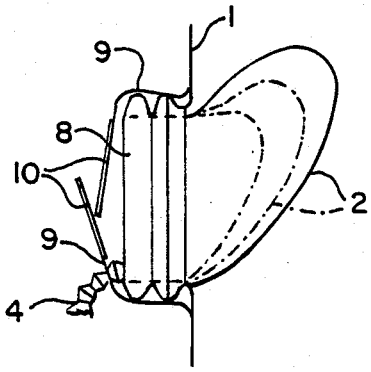
FIG. 3 is an enlarged detail view of the upper portion of FIG. 2, showing the inflatable bag of this invention in expanded condition.

Belt 1 has a centrally disposed opening sized and positioned to encompass the user's abdomen; attached to belt 1 around this opening is pocket 8 extending outwardly from belt 1 in a folded bellows-like configuration to permit outward expansion. As shown in FIGS. 1 and 3. two overlapping flaps 9 are fastened in hinge-like fashion to belt 1 and positioned to overlie pocket 8 (FIG. 3); flaps 9 can be held together by means of fastening elements 10, very much like fastening elements 7 described above. When closed and overlapped, flaps 9 form a restraining cover over pocket 8, and their relative overlapping selectively and adjustably limits pocket 8's outward expansion.

Figure 2:
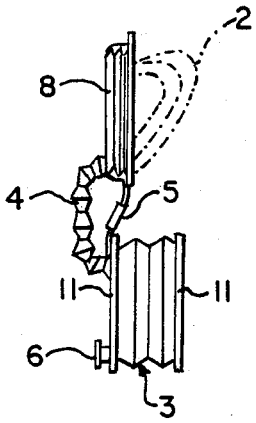
FIG. 2 is a right side elevational view of the device of FIG. 1.

Air-tight inflatable bag 2 is fixed to the lower edge of pocket 8 and positioned in flat condition completely therein when at rest in the solid line position shown in FIG. 2; when inflated, bag 2 is adjustably restrained by pocket 8 and flaps 9 from moving outwardly from belt 1, therefore expanding inwardly either to the extreme solid-line position of F1g. 3 or to one of the intermediate dotted-line positions of FIGS. 2 and 3. Thus the expansion of bag 2 exerts an adjustably variable pressure against the user's abdomen inwardly and upwardly to stretch the abdominal muscles in urging them into the upper position of an effective abdominal lift.

Figure 4:
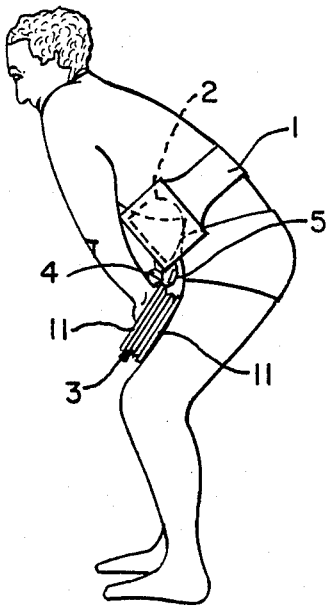
FIG. 4 is a side elevational view of the exercise device in position on an exerciser and in use.

The inflation of bag 2 is accomplished by the operation of bellows type pump 3 propelling air into bag 2 through connecting flexible air conduit hose 4. Air pump 3 is suspended from belt 1 by a pair of adjustable straps 5 so that when the exercise device of this invention is in use, pump 3, which may be covered conveniently with front and back flat plates 11, rests comfortably on the user's thighs, as may be seen in FIG. 4. In operation, bellows pump 3 is compressed by exerciser's hands, as shown, against his thighs so that air is pumped through conduit 4 into inflatable bag 2; when released by the hands, pump 3 is reinflated by the action of light compression springs therewithin (not shown) so that air is withdrawn through conduit 4 from bag 2. This completes a single abdominal lift exercise cycle and relaxes the exerciser's abdominal muscles until hand pressure is applied again to pump 3. Thus, pump 3, conduit 4 and bag 2 together form an essentially air-tight reversible air transfer system.

The size of bellows pump 3 and the volume of air it delivers to bag 2 are selected to provide sufficient inflation of bag 2 for effective abdominal lifting. A normally closed air valve 6 is provided on front plate 11, as shown in FIGS. 1 and 2, to be opened in order to deflate bellows pump 3 for maximum portability.

A preferred embodiment of the present invention has been described in detail as illustrative of the principles and concepts which underlie it. To satisfy the requirements of a variety of abdominal lift exercises, the elements of the preferred embodiment are subject to modification or substitution obvious to those skilled in the art without departing from the spirit and scope of this invention, which are defined and limited only by the ensuing claims.

What is claimed is:

1. Device for performing abdominal lift exercises comprising:

a flexible body belt adapted to be fastened adjustably and removably about an exerciser's waist, said body belt having a centrally disposed opening, said opening facing and corresponding in size and position to the exerciser's abdomen;

an expandable pocket mounted on said body belt, said pocket being affixed to the periphery of and surrounding said belt opening, said pocket being in the form of a bellows capable of being expanded outwardly and having an opening toward, facing sand corresponding in size and position to said belt opening and the exerciser's abdomen;

an air-tight infaltable bag attached to the lower edge of said pocket, said bag being contained completely within said pocket when not inflated, said bag being shaped to protrude through said pocket opening and to press inwardly and upwardly directly against the exerciser's abdomen through said belt opening and said pocket opening when inflated;

adjustable control means for regulating the magnitude of air pressure directed against the exerciser's abdomen, said adjustable control means being mounted on said body belt and being characterized by the ability to limit and control selectively the expansion of said pocket and said bag outwardly from said body belt, thus directing more of less of said air pressure against the abdomen;

a bellows-type air pump adjustably suspended from said body belt, said air pump being adapted to rest against the exerciser's thighs and to be operated by hand pressure thereagainst; and flexible conduit means connecting said air pump and said inflatable bag for transmitting air therebetween.

2. Device for performing abdominal lift exercises as defined by claim 1, wherein said adjustable control means comprises a pair of flaps hingedly mounted facing each other on opposite sides of said body belt opening, said flaps being adjustably attachable to each other to form a restraining cover over said pocket and thus selectively limiting the outward expansion of said pocket and said inflatable bag from said body belt, thereby directing more or less pressure against the exerciser's abdomen.

* * * * *

UNITED STATES PATENT AND TRADEMARK OFFICE

CERTIFICATE OF CORRECTION

PATENT NO. : 4,824,105

DATED : April 25, 1989

INVENTOR(S) : Zinovy Goldenberg

It is certified that error appears in the above-identified patent and that said Letters Patent is hereby corrected as shown below:

Column 1, line 53, "without" should read -- within --.

Column 2, line 42, "3." should read -- 3, --.

Column 2, line 56, "FIg." should read -- FIG. --.

Column 4, line 2, "sand" should read -- and --.

Column 4, line 19, "of" should read -- or --.

Signed and Sealed this

Thirteenth Day of February, 1990

*Attest:*

JEFFREY M. SAMUELS

*Attesting Officer* *Acting Commissioner of Patents and Trademarks*